United States Patent [19]

Jullian

[11] Patent Number: 5,014,622

[45] Date of Patent: May 14, 1991

[54] BLASTING SYSTEM AND COMPONENTS THEREFOR

[76] Inventor: Michel Jullian, 103 Scholle Road, Aylmer, Quebec, Canada, J9H 5C9

[21] Appl. No.: 483,363

[22] Filed: Feb. 22, 1990

Related U.S. Application Data

[63] Continuation of Ser. No. 221,435, Jul. 19, 1988, abandoned.

[30] Foreign Application Priority Data

Jul. 31, 1987 [GB] United Kingdom ..... 8718202

[51] Int. Cl.[5] ..... F42B 3/00

[52] U.S. Cl. ..... 102/312; 102/313; 102/215; 102/217

[58] Field of Search ..... 102/312, 313, 215, 217

[56] References Cited

U.S. PATENT DOCUMENTS

| | | | |
|---|---|---|---|
| 4,136,617 | 1/1979 | Fowler | 102/220 |
| 4,145,970 | 3/1979 | Hedberg | 102/218 |
| 4,419,933 | 12/1983 | Kirby et al. | 102/206 |
| 4,445,435 | 5/1984 | Oswald | 104/215 |
| 4,537,131 | 8/1985 | Saunders | 102/217 |
| 4,625,205 | 11/1986 | Relis | 102/217 X |
| 4,644,864 | 2/1987 | Komorowski et al. | 102/206 X |
| 4,674,047 | 6/1987 | Tyler et al. | 364/423 |
| 4,680,584 | 7/1987 | Newson et al. | 340/850 |
| 4,712,480 | 12/1987 | Lindstadt et al. | 102/215 X |
| 4,796,531 | 1/1989 | Smithies et al. | 102/217 |
| 4,928,570 | 5/1990 | Esterlin et al. | 102/215 X |
| 4,934,269 | 6/1990 | Powell | 102/215 X |

FOREIGN PATENT DOCUMENTS

| | | | |
|---|---|---|---|
| 1188777 | 11/1985 | Canada . | |
| 0174115 | 3/1986 | European Pat. Off. . | |
| 2551197 | 3/1985 | France | 102/215 |

OTHER PUBLICATIONS

Hinzen et al., "A New Approach to Predict and Reduce Blast Vibration etc.", 1/30/87.

*Primary Examiner*—Peter A. Nelson
*Attorney, Agent, or Firm*—Sim & McBurney

[57] ABSTRACT

An explosive device receives signals specifying a unique communications address for use in a blasting circuit and a required blasting delay. The device has an electric igniter, but no independent power source which might cause accidental detonation. In an address and delay setting mode, when the device is being handled by a blaster, a unipolar signal is transmitted to the device to charge only a control power supply for general communications. In a blasting mode, a bipolar signal is transmitted to charge both control and igniter power supplies. A security code must, however, be transmitted to enable charging of the igniter power supply. Prior to detonation, each explosive device in a blasting circuit responds to a calibration signal by generating a timing circuit test count. A blasting machine processes nominal delays and test counts, and transmits adjusted delays to synchronize operation. A firing signal is recognized only if it contains a predetermined number of coded components thereby providing immunity to electromagnetic noise. The device is safely removed from a blasting circuit by transmitting a disarming signal which causes its igniter power supply to be discharged.

14 Claims, 7 Drawing Sheets

BLASTING SYSTEM AND COMPONENTS THEREFORE

This application is a continuation of Ser. No. 221,435, filed July 19, 1988, and now abandoned.

FIELD OF THE INVENTION

The invention relates to blasting systems, and more specifically, to a novel blasting cap which offers improved reliability, greater safety during handling, and universal application and to devices for controlling the operation of such blasting caps.

DESCRIPTION OF THE PRIOR ART

In the blasting of a particular site such as a mine shaft, quarry or the like, the general object is to progressively remove exterior portions of the blast site in a single blasting operation until a cavity of a desired size is formed. An array of blasting caps will consequently be installed at different depths in the blast site and connected with appropriate conductors to form a single blasting circuit. A detonator or blasting machine will normally transmit a single firing signal along the wires to the blasting caps. It is consequently imperative that each blasting cap experience a different blasting delay. At present, it is common to provide different blasting delays by forming the blasting caps with pyrotechnic fuses incorporating different delay powders and different igniting configurations. All fuses are ignited in response to the firing signal and different delays occur before each blasting cap is detonated.

There are a number of significant problems associated with such blasting systems. In particular, a multiplicity of different blasting caps with different delays must be provided. The delay settings are normally in predefined increments which limits the ability of the blaster to select blasting delays appropriate for a particular site. When installed in a blasting circuit, there is no convenient and reliable mechanism for checking the continuity of the blasting circuit and determining whether all blasting caps will in fact detonate in response to a firing signal. Accordingly, such conventional blasting systems require personnel with considerable experience who must exercise considerable diligence and attention to produce reliable results.

Such blasting systems are also prone to unreliable results even when used by very skilled personnel. Limitations in the manufacture of conventional pyrotechnic fuses tend to produce different delays even in blasting cap having the same nominal delay value. Dampness, aging, and handling can thereafter further affect the nominal blasting delay. Accordingly, the blaster cannot be certain whether the nominal delay specified by a manufacturer is in fact representative of the actual blasting delay which a blasting cap will experience.

Such blasting systems also present considerable safety hazards. Conventional electrically-powered blasting caps can be detonated whenever sufficient power is applied to them. Radio transmission, lightning, static charges and other occurrences can potentially cause detonation. Also, since conventional blasting caps can be detonated by simply applying an appropriate current or voltage, the blasting caps used in such systems can be misappropriated and readily used by unauthorized persons.

BRIEF SUMMARY OF THE INVENTION

In one aspect the invention provides an explosive device whose blasting delay can be selected or programmed by the blaster thereby providing a single universal blasting device. The explosive device has igniter means for igniting the associated charge, when actuated. Control means are provided to regulate operation of the igniter means. The control means include communication means for receiving signals transmitted to the device, including a blasting signal and a blasting delay signal specifying a required blasting delay, and recording means for recording at least the specified blasting delay. The recording means may be an electrically erasable programmable read-only memory (EEPROM) where the blasting delay can be stored on a relatively permanent basis together with data required for other functions, and may include as well a random access memory (RAM), registers and counters where the blasting delay and other data can be stored on a temporary basis when the explosive device is active. The control means include timing means for determining when a time interval corresponding to the recorded blasting delay has expired following receipt of the blasting signal. In a preferred embodiment of this invention, the required timing function is provided by storing the recorded blasting delay in a counter and applying clock pulses to the counter upon receipt of a valid blasting signal until the counter counts effectively counts through the required blasting delay. Igniter actuating means serve to actuate the igniter means and are controlled by the control means at least in part in response to expiry of the time interval. The control means may control ignition of the associated charge in response to other signals such as security codes.

In another aspect, the invention provides an explosive device which is capable of communicating with an external control device to confirm that the explosive device is operative or to provide information such as its nominal blasting delay. In another aspect, the invention provides explosive devices which can be installed in a blasting circuit and which can then communicate with a control device in such a manner that proper connection of each explosive device to the blasting circuit can be verified.

In another aspect the invention provides an explosive device which is electrically powered with energy transmitted from an external control device. The explosive device has separate power supply means for purposes of enabling communications with the control device and for purposes of igniting an associated explosive charge. Means are provided which permit the communications function to be selectively enabled separate from the igniting function thereby ensuring that explosive device is not armed until finally installed in a blasting circuit and otherwise prepared for detonation. In another aspect, such an explosive device responds to a disarming signal to disable its igniter power supply thereby permitting safe and reliable removal of the device from a blasting circuit whenever such removal is required.

In a still further aspect, the invention provides an explosive device with an electronic blasting delay mechanism which can be calibrated to ensure proper and timely detonation relative to similar explosive devices in a blasting circuit.

In further aspects, the invention provides control devices adapted to communicate with electronic explosive devices of the invention for purposes of setting explosive device delays, verifying the operability of such explosive devices, calibrating blasting delays, checking blasting circuit continuity and the like.

DESCRIPTION OF THE DRAWINGS

Other inventive aspects will be apparent from a description below of a preferred blasting system.

The invention will be better understood with reference to drawings in which.

DESCRIPTION OF PREFERRED EMBODIMENTS

Figure 1:
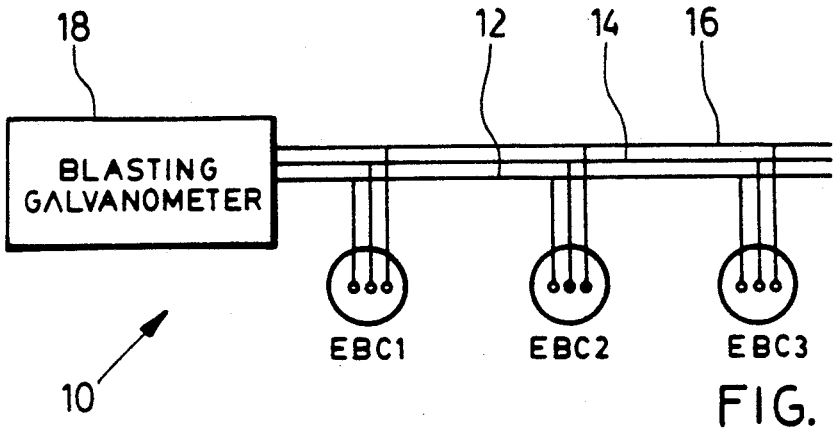
FIG. 1 diagrammatically illustrates the overall configuration of a blasting system.

Reference is made to FIG. 1 which illustrates a blasting system 10 which operates according to the principles of the present invention. The blasting system 10 may be seen to comprise three transmission lines: a power line 12, a communications line 14, and a common or ground line 16. Three electronic blasting caps constructed according to the invention are shown connected in parallel to the three transmission lines 12, 14, 16 and have been designated EBC1–EBC3 inclusive. The blasting circuit is shown coupled to a blasting galvanometer 18 but may be coupled in a similar manner to a blasting machine 20 when it is appropriate to detonate the various blasting caps. It will be appreciated that the number of blasting caps normally involved in such a blasting circuit would be dictated by the requirements of a particular blasting operation and only three have been illustrated for purposes of describing the principles inherent in the invention.

The expression "blasting galvanometer" is a term of the blasting art which identifies a blasting cap checking device. This designation should not be regarded as implying that the device 18 is of a conventional nature. The device 18 does in fact embody features and operating principles which have not heretofore been used in connection with prior devices.

The blasting galvanometer 18 has two principal modes of operation. In one mode, the blasting galvanometer 18 is coupled directly to a single blasting cap to perform a number of operations including testing whether the blasting cap is operative, setting a unique address within the blasting cap for purposes of communication with the blasting cap (as in a blasting circuit), and setting a blasting delay which the blasting cap implements before detonating in response to a firing command or signal. In the other mode of operation, the blasting galvanometer 18 is connected to a blasting circuit substantially as illustrated in FIG. 1. In the latter mode of operation, the principal function of the blasting galvanometer 18 is to verify which blasting caps are properly connected to the blasting circuit and operative. It is also possible in this mode of operation to set blasting cap addresses and delays individually; however, operation is modified to require the blaster to specify the address of a particular blasting cap in connection with each operation.

Figure 2:
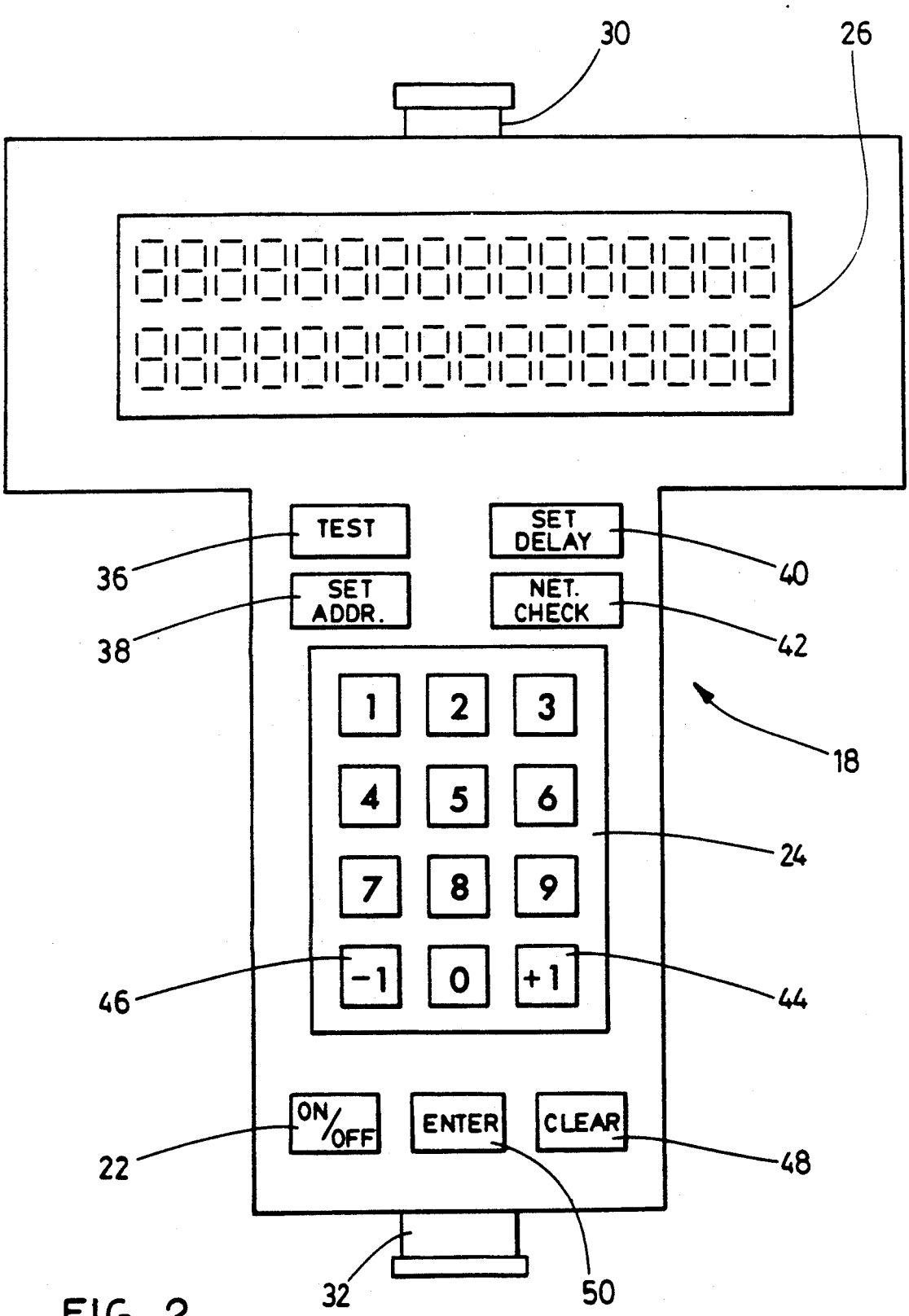
FIG. 2 is a plan view illustrating external features of a blasting galvanometer.

The external configuration of the blasting galvanometer 18 will be apparent in FIG. 2. A power switch 22 serves to power the blasting galvanometer 18 from a battery contained therein. A keyboard 24 permits a blaster to compose and enter data such as blasting cap addresses and delays. The information composed at the keyboard 24 and any response or prompt from the blasting galvanometer 18 is displayed on a two-line liquid crystal display 26 permitting display of up to 32 alphanumeric characters. A connector 30 permits the galvanometer 18 to be coupled either directly to a single blasting cap or to the power, communications and common lines of a blasting circuit. A second connector 32 permits the blasting galvanometer 18 to be coupled to an auxiliary power supply (not illustrated) of greater output capacity for purposes of enabling communications with a large number of blasting caps in a blasting circuit.

The blasting galvanometer 18 comprises a number of keys which permit the initiation of various galvanometer functions. These include a test key 36 which initiates a functionality test with respect to a single blasting cap connected directly to the galvanometer 18, a set address key 38 which initiates the setting of a new address for purposes of communications with a particular blasting cap, and set delay key 40 which initiates the setting of a new blasting delay for a particular blasting cap. A network check key 42 can be depressed to initiate a functionality test with respect to all blasting caps in a blasting circuit.

The blasting galvanometer 18 has a number of additional keys which can be used in connection with the operations. An increment key 44 permits displayed or recorded numeric values to be incremented by a single unit and is used primarily to set consecutive communications addresses for blasting caps which are to be installed in a blasting circuit. A decrement key 46 permits displayed or recorded numeric values to be decremented. A clear key 48 initiates the cancellation of any current operation. An enter key 50 permits the blaster to acknowledge messages displayed by the blasting galvanometer 18 and to enter data composed at the keyboard 24, all in a conventional manner.

Figure 3:
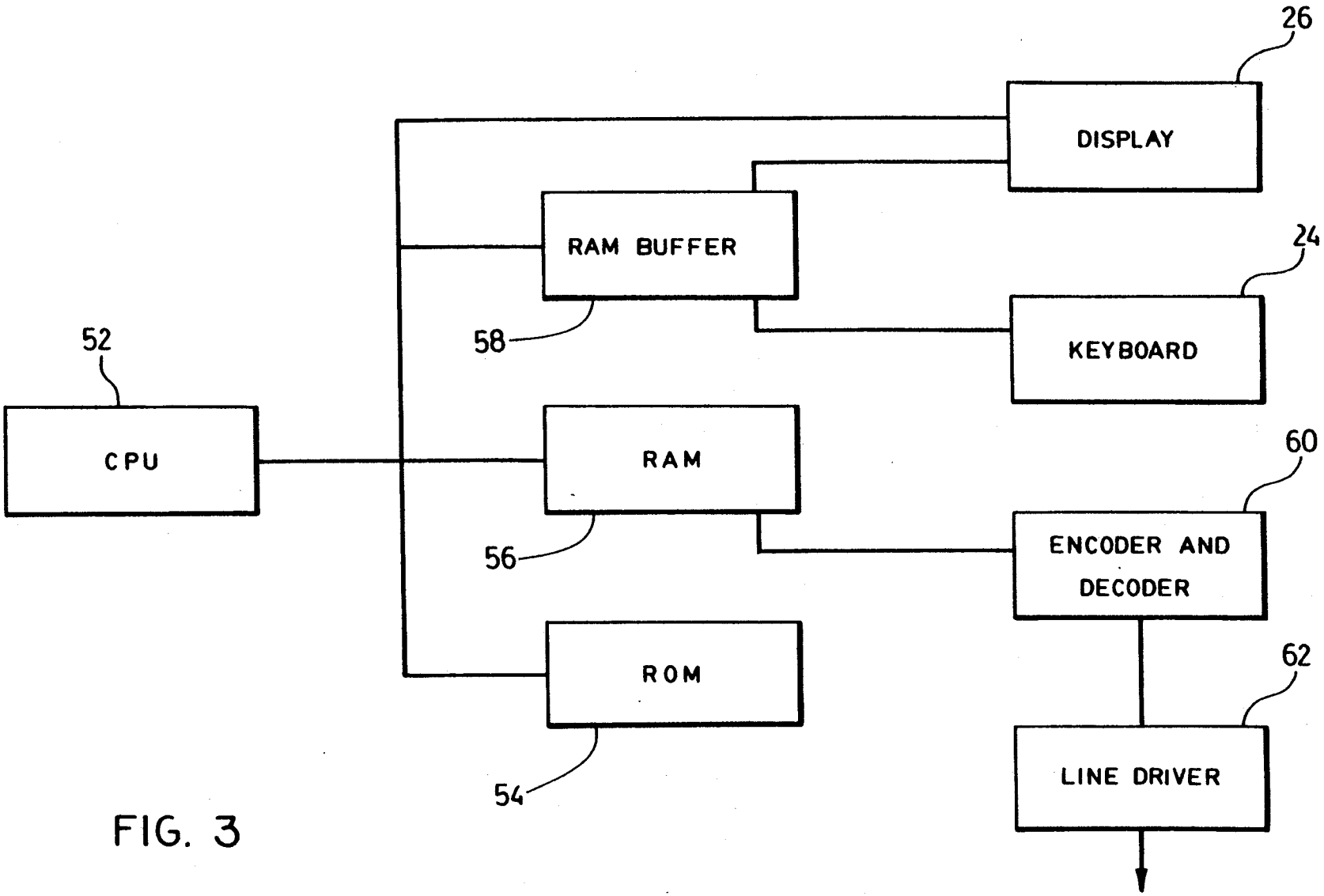
FIG. 3 is a schematic representation of the electronic components associated with the blasting galvanometer.

The principal components of the electronic circuitry associated with the blasting galvanometer 18 are schematically illustrated in FIG. 3. The blasting galvanometer 18 comprises a central processing unit (CPU) 52 which regulates overall operation. In the description of operation which follows, it should be understood that any reference to the blasting galvanometer 18 performing a particular function relates in fact to the CPU 52 initiating and regulating such functions. The CPU 52 is associated a read-only memory (ROM) 54 which contains programming code that determines how the CPU 52 responds to actuation of the various keys and implements the various operations described below. The appropriate programming of such operations are matters which will be apparent to persons knowledgeable regarding programming. A RAM 56 permits temporary storage of data such as the address and delay setting retrieved from a blasting cap.

A RAM buffer 58 is optionally used in connection with data transfer to and from the CPU 52. The buffer 58 interfaces the CPU 52 with the keyboard 24 and the various control keys, and also with an encoder/decoder unit 60 for purposes of data transfer to and from the blasting galvanometer 18. The encoder/decoder unit 60 is associated with a line driver 62 that may include a noise filter and a Schmitt trigger or similar circuitry for ensuring that proper data pulses are generated. The line driver 62 couples the signals generated by the encoder/decoder unit 60 to a communications terminal, ultimately for transmission to a direct-connected blasting cap or to a blasting circuit.

The blasting galvanometer 18 has a 12 volt DC power supply (not illustrated) which is used not only to operate the blasting galvanometer 18, but also to power a blasting cap attached directly to the connector for purposes of communications. This battery voltage may be converted in a conventional manner to a 5 volt level for purposes of powering the logic circuitry associated with the galvanometer 18 and to a 48 volt level used in connection with the operations of the blasting caps (discussed more fully below). In this particular embodiment of the blasting galvanometer 18, attachment of the auxiliary supply to the connector 32 disconnects the internal 12 volt battery and signals the CPU 52 to disable operations relating to a single direct-connected blasting cap and enable operations pertinent to inspection of an entire blasting circuit.

The blasting galvanometer 18 is programmed to generate and display a number of messages when the various switches and keys associated with the blasting galvanometer 18 are operated. The principal messages of interest to the present invention are described in Table 1 at the end of this disclosure. As well, the blasting galvanometer 18 may be adapted to display message indicating a low battery voltage, a blasting galvanometer 18 malfunction, and whether the device is ready to receive further instructions.

In this particular embodiment of a blasting system, the blasting machine 20 performs functions only with respect to a blasting circuit as opposed to individual blasting caps. These functions include transmission of a security code necessary to enable firing circuitry associated with the blasting caps. The blasting machine 20 can also transmit a predetermined calibration signal for purposes of testing timing circuits in the blasting caps, retrieve a calibration test count generated by each blasting cap, and then adjust the programmed delay associated with each blasting cap to accommodate differences in the clock rates. The blasting machine 20 can also arm each blasting cap, which in this particular embodiment of the invention involves charging a distinct igniter power supply associated with the blasting cap. The blasting machine 20 has a corollary function which permits all blasting caps in the blasting circuit to be disarmed, which involves actually discharging the igniter power supplies to permit a blaster to handle the blasting caps safely. As well, the blasting machine 20 is capable of transmitting a fire signal to a blasting circuit to initiate delay counting in each blasting cap and ultimately detonation.

Figure 4:
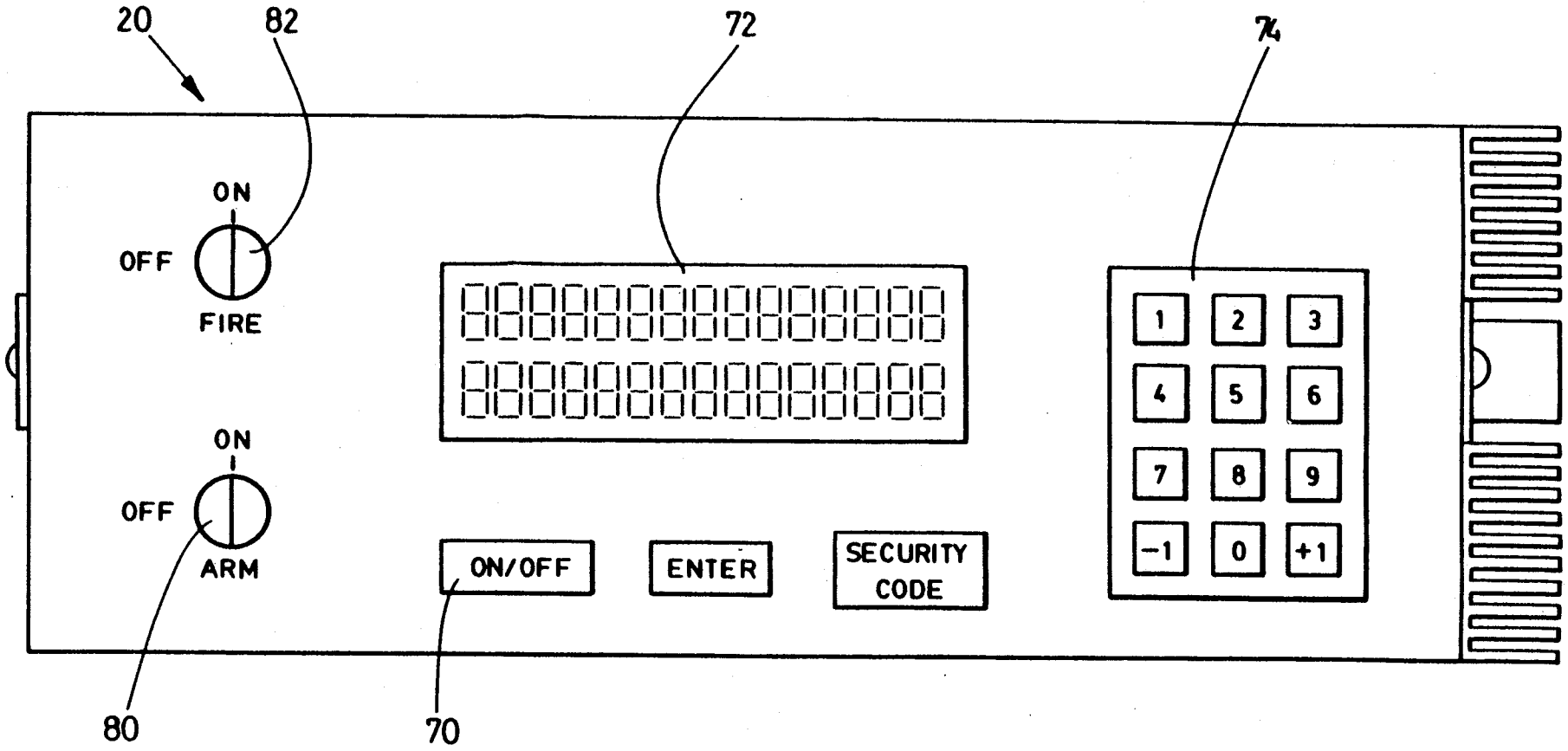
FIG. 4 is a plan view illustrating external features of a blasting machine.

The principal external features of the blasting machine 20 are illustrated in FIG. 4. A power toggle switch 70 permits the blasting machine 20 to be powered from an internal battery 84. A liquid crystal display 72 permits the composition and display of messages comprising up to 32 alphanumeric characters. A numeric keyboard 74 including increment and decrement key permits the blaster to enter data such as the security code required to enable detonation of the blasting caps or a range of address for blasting caps in the blasting circuit connected to the blasting machine 20.

The blasting machine 20 also comprises two lock switches, an arm lock switch 80 and a fire lock switch 82, each of which can be operated only with an appropriate key. The arm lock switch 80 has an ON position in which calibration of blasting caps is initiated and in which power is transmitted to the blasting caps in such a manner that not only are the blasting caps powered for purposes of communications but also for detonation. The arm lock switch 80 has an OFF position in which the blasting caps receive a signal causing them to discharge their associated igniter circuits. The fire lock switch 82 can be moved to an ON position to transmit a firing signal to the blasting caps of the blasting circuit which initiates a delay counting process in each blasting cap and then detonation.

Figure 5:
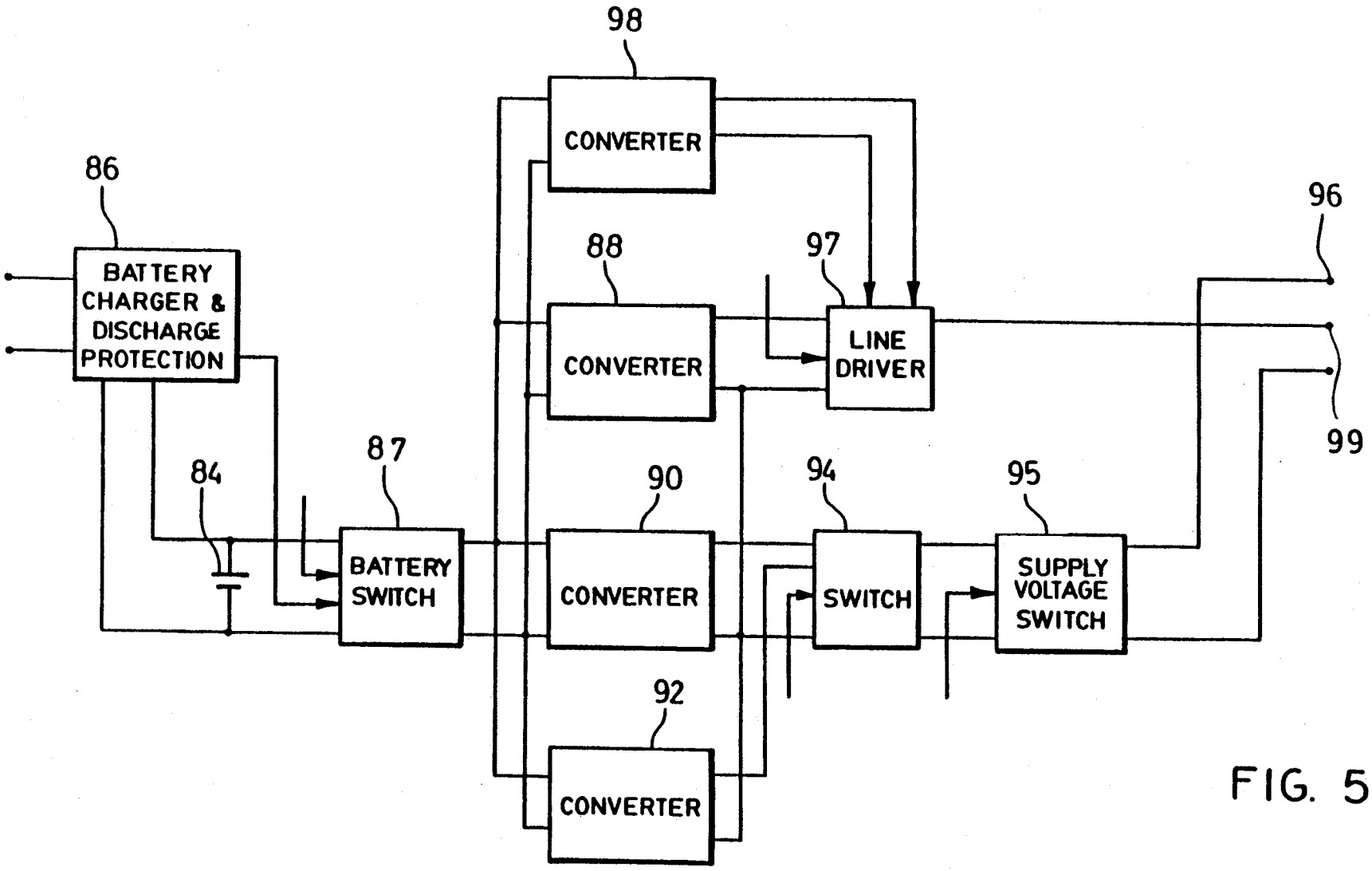
FIG. 5 is a schematic representation of a power supply associated with the blasting machine.

The blasting machine 20 has an internal configuration which is similar to that of the blasting galvanometer 18 and accordingly has not been illustrated. A principal exception is its power supply which is illustrated in FIG. 5 (where unterminated lines to principal components with indicate control lines coupled to a CPU associated with the blasting machine). The power supply may be seen to comprise a 12 volt battery 84 and a battery charger 86 adapted to charge the battery 84 when coupled to an AC line source. A battery switch 87 serves as an off-on switch coupling and decoupling the battery 84 from the rest of the power supply circuitry as during charging operations. The supply includes a converter 88 which reduces the battery voltage to 5 volts for purposes of operating the logic circuitry associated with the blasting machine 20. Two converters 90, 92 step the battery voltage to 48 volts and −20 volts respectively. These voltages are received by a voltage switch 94 which controls whether the 48 or −20 volts is applied through an on-off voltage supply switch 95 to a power output terminal 96 (which in use would be coupled to the power line 12 of the blasting circuit). The operation of the voltage switch 94 is regulated by the CPU associated with the blasting machine 20. When the arm switch is moved to the ON position, and a calibration function (described more fully below) has been implemented by the CPU, the switch 94 is controlled so as to generate a square wave type signal whose positive cycles have a voltage of 48 volts and whose negative cycles have a voltage of 20 volts. The power supply also includes a line driver 97 powered by a separate converter 98. The line driver 97 is controlled by the CPU associated with the blasting machine 20 and applies to a communications output terminal 99 either 0 volts or the 5 volts supplied by the converter 88. The communications output terminal 99 would normally be coupled to the communications line 14 associated with the blasting circuit.

The blasting machine 20 is programmed to display an number of messages to the blaster in connection with the operation of its keyboard 74 and various switches. The principal messages relevant to the present invention are indicated in Table 2 at the end of this disclosure. As well, the blasting machine 20 may be adapted to generate messages indicating a low battery voltage, a blasting machine malfunction, readiness to accept a new command, and current processing of a command.

Command signals and data are transmitted between a blasting cap and either the blasting galvanometer 18 or the blasting machine 20 in the form of data packets. Communications generally take one of two formats: in a first format, a command packet may be addressed to a particular blasting cap and a response packet is returned by the addressed blasting cap; in a second format, a global command packet is transmitted to initiate action in all blasting caps of a blasting circuit, but no response packet is returned by any blasting cap. An exception is a QUERY ADDRESS command (described more fully below) which is a global command directed to all blasting caps in a blasting circuit and which prompts the return of a response packet by one blasting cap. To permit such communications, each blasting cap is adapted to respond to two different addresses: a first address which is assigned to and recorded in the blasting cap and which uniquely identifies the blasting cap; and a second, universal address which is common to all blasting caps and in this particular embodiment of a blasting system is a zero address, a bit stream composed entirely of logic zero values. For purposes of this specification, a "universal address" should be broadly understood as a communications address which is always available for communications with a blasting device and which is not altered by the blaster in any addressing functions inherent in the operation of a blasting system.

Figure 6A:
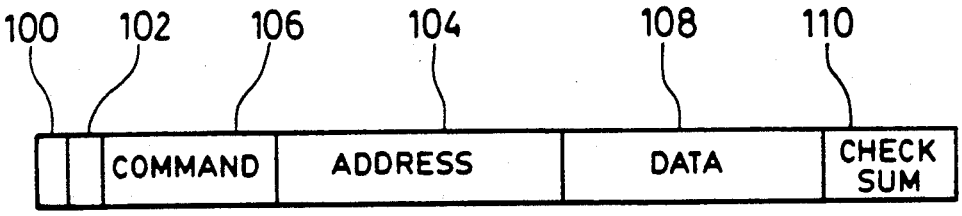
FIG. 6*a* diagrammatically illustrates the general format of a data packet used in transmitting commands and response messages in the blasting system of FIG. 1.

In general communications requiring a response from a particular blasting cap, the blasting galvanometer 18 or blasting machine 20 acts as the master unit and the addressed blasting cap acts as a slave unit which returns a response packet either containing data requested by the response packet or simply data confirming receipt of the command packet. A typical packet used in connection with such communications is illustrated in FIG. 6*a*. The packet has a synchronization bit 100 at the leading end thereof which is a logic low value (the communications line 14 being at 5 volts DC in an idle state) which indicates to a blasting cap, the blasting galvanometer 18 or blasting machine 20 the start of a packet. An identification bit 102 is used to indicate whether the data packet originated with the blasting galvanometer 18, blasting machine 20 or one of the blasting caps: the bit is at a logic high to indicate a command packet from the blasting galvanometer 18 or blasting machine 20 and at logic low value to indicate a response packet from a blasting cap. The packet has an address field 104 which is used to identify the blasting cap to which the command is directed. Each blasting cap is programmed to decode and to discard any command packet which is not addressed to the particular blasting cap or otherwise transmitted to the universal address. A command field 106 of four bits follows the address field 104 and can be used in a command packet to encode any particular command associated with the packet. A data field 108 is provided for transmission of information such as a new address and a new delay setting. The response packet from a blasting cap will normally repeat its address in the address field and the command identification code of the command packet which initiated its response in the associated associated command field. The data field of a response packet will often comprise the current address and delay stored in any particular blasting cap or the current value stored in one of several counters associated with the blasting cap and described more fully below. Lastly, the packet comprises an 8 bit check sum 110 at a trailing end thereof. The check sum is used in a conventional manner to detect transmission errors. In the particular system described, the blasting galvanometer 18 or blasting machine 20 will attempt up to eight transmissions of a command packet without return of a response packet before blasting cap malfunction is assumed.

Most global commands involve a packet format similar to the command and response packets described above, except that the address field associated with global commands will normally comprise a stream of zero bits (the universal address). The fire and calibrate commands have a somewhat different format which is described in greater detail below.

Figure 6B:
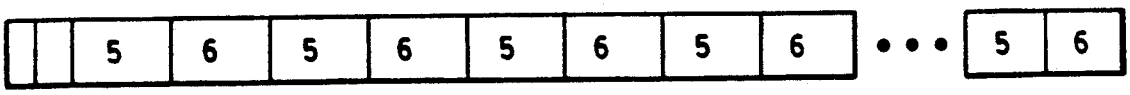
FIG. 6*b* diagrammatically illustrates the format of a firing signal used in the blasting system to detonate electronic blasting caps.

The firing command is diagrammatically illustrated in FIG. 6*b*. This command is a large packet comprising a data field of 10,240 bits composed of distinct message components, specifically 1280 repetitions of the bit pattern "01010110", the higher order byte being the binary coded decimal (BCD) representation of the numeral 5 and the lower order byte being the BCD representation of the numeral 6. As described more fully below, when the firing command is transmitted over the communications line 14 of the blasting circuit, each blasting cap counts the distinct digit patterns encoded in the data field and recognize a valid fire command only if 1280 signal components are detected less an error which is no greater than 255 miscounts or 20% of the total transmission. The generous error range of 255 miscounts ensures that a valid firing command is recognized despite the presence of a large measure of electromagnetic noise and yet there is little likelihood that such noise or another command signal corrupted by noise will be construed by the blasting caps as a firing command.

The calibrate command is of a similar nature but comprising 12,800 repetitions of the bit pattern "01011001", namely, the BCD representations of the numerals 5 and 9, which lasts a total of about 10 seconds. This ensures that the calibrate command is readily distinguished from the firing command and all other general purpose commands which may be transmitted to a blasting cap. In connection with a calibration function described more fully below, each blasting cap detects and tallies the number of distinct code segments contained in the calibrate command and indicates a failure in its its calibration mode of operation if less than 12,800 repetitions of the data segments less an error or miscount of 20% are noted. This accordingly indicates disruption of the calibration process by extraneous noise or other factors.

Figure 7:
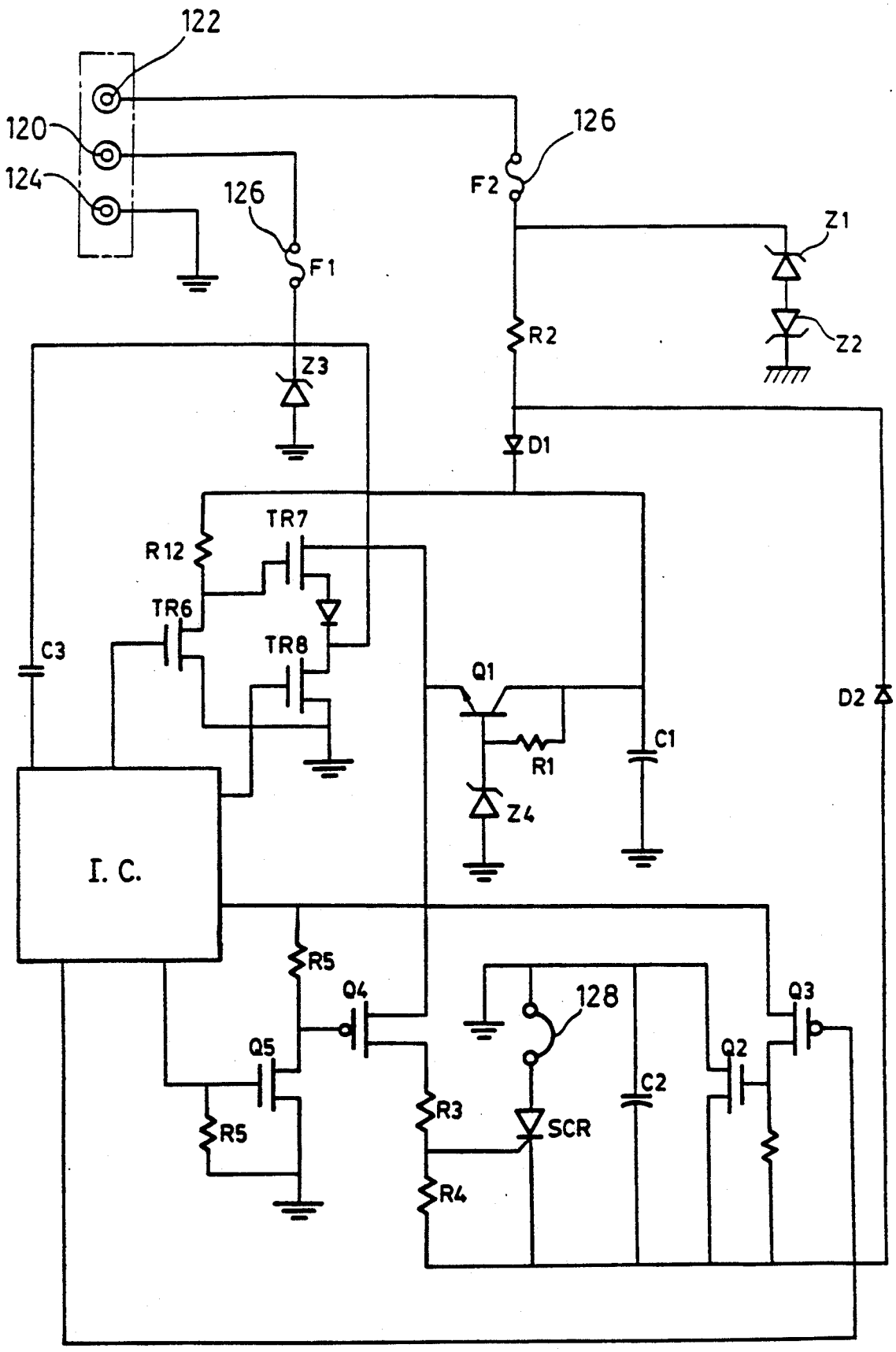
FIG. 7 schematically illustrates one of the electronic blasting caps shown in the blasting system of FIG. 1.

An overall schematic representation of the blasting cap EBC1 is provided in FIG. 7. The blasting cap comprises three terminals which are accessible at the exterior of its housing: a communications terminal 120, a power terminal 122, and a reference or common terminal 124. When coupled to a blasting circuit, as for example in the arrangement shown in FIG. 1, the communications terminal 120 would be coupled to the communications line 14; the power terminal 122, to the power line 12; and the reference terminal 124, to the reference line 16.

It will be noted that the communications and power terminals 120, 122 are associated with fuses 126 intended to protect the electronic blasting cap against currents exceeding normal operating parameters. Once such fuses are blown, the blasting cap is for all practical purposes defective and must be replaced. The power supply terminal is also protected by a pair of back-to-back zener diodes Z1, Z2 against static voltages potentially produced by human contact. The communications terminal 120 is similarly protected by a single zener diode Z3.

The blasting cap has two distinct power supplies: a control logic supply and an igniter circuit supply. Both power supplies include capacitors chargeable with electric energy transmitted to the blasting cap, and no active power source such as a battery is present in the blasting cap. This provides an added measure of safety in the general handling of the blasting caps.

The control logic power supply is a 5 volt supply intended primarily to operate an integrated circuit (IC) and those electronic components required to communicate with either the blasting galvanometer 18 or blasting machine 20. The igniter power supply serves solely to supply power to a bridge wire 128 which ignites a conventional explosive charge (not illustrated) associated with the blasting cap. With a power gating mechanism described more fully below, this arrangement permits the blasting cap to be powered to enable communications with the blasting cap without arming the blasting cap for detonation. This provides an added measure of safety in the handling of such devices.

The control power supply comprises a capacitor C1 which can normally be charged up to about 45 volts DC. In use, the required charging voltage is applied to the power terminal 122 of the blasting cap EBC1 either directly (as when the blasting cap EBC1 is connected directly to the blasting galvanometer 18) or over the power transmission line 12) when the blasting cap EBC1 is connected to the blasting circuit). A transistor Q1 and zener diode Z4 coupled to the capacitor C1 produce the nominal 5 volt supply required to power the IC. A resistor R1 ensures that both the zener diode Z4 and the transistor Q1 receive sufficient biasing current for proper operation. Since the integrity of the power transmission line 12 is lost during the detonation process, the capacitor C1 has a capacity which is sufficient to maintain IC operation from the time the blasting cap receives a firing command through countdown until ultimate detonation.

The igniter power supply includes a capacitor C2 which must be charged in order to arm the blasting cap for detonation. A silicon controlled rectifier designated with the reference characters SCR controls discharging of the capacitor C2, when the silicon controlled rectifier is appropriately actuated, through the bridge wire 128 used to ignite the charge associated with the blasting cap. The capacitor C2 is shunted by a metal oxide semiconductor field effect transistor (MOSFET) Q2. Since the transistor Q2 is an enhancement mode device, it will normally assume a conductive state in which the capacitor C2 is shorted by the transistor and cannot be charged. This is a significant safety feature which accommodates any uncertainty in logic states and voltages during start-up. Accordingly, steps must be taken to turn off the transistor Q2 before the blasting cap can be armed for detonation.

The conductive state of the transistor Q2 is controlled by the IC in conjunction with a transistor Q3 (MOSFET) and a resistor R14. Depending on its conductive state, the transistor Q3 can couple the gate of the transistor Q2 to the 5 volt supply to turn the transistor Q2 off. Since the transistor Q3 is a depletion mode device which is normally non-conductive, it is normally disposed to isolate the gate of the transistor Q2 from the 5 volt supply, leaving the transistor Q2 operative and shorting the capacitor C2, once again providing an additional measure of safety during start-up of the blasting cap EBC1. In response to a command signal transmitted to the communications terminal 120 of the blasting cap EBC1, the IC applies to the gate of the transistor Q3 a voltage which turns the transistor Q3 on. This in turn couples the gate of the transistor Q2 to the 5 volt supply turning the transistor Q2 off and permitting charging of the capacitor. In normal operation, the IC maintains the capacitor C2 in a shorted and discharged state until an arming signal is transmitted to the blasting cap BC1 requiring the device to arm itself. Since continuity of the power line 12 is lost during the detonation process, the capacitor C2 is selected to have sufficient capacitance that, once charged, the capacitor C2 can drive the bridge wire 128 and detonate the charge without additional transmission of power to the blasting cap EBC1.

Means are provided in the blasting cap EBC1 to permit the control logic power supply and the igniter power supply to be selectively charged from externally of the blasting cap EBC1. Two power transmission or charging paths are provided from the power terminal 12 to each of the capacitors C1 and C2. A resistor R2 serves as common current limiter in each charging path, being coupled by a diode D1 to the capacitor C1 and by a diode D2 to the capacitor C2. The diodes D1 an D2 are of course unidirectional semiconductor devices conducting current only in a single direction and their orientation in each o the two charging paths is such that the capacitor C1 charges only when a signal applied to the power terminal 122 has a positive polarity and the capacitor C2 charges only when the signal has a negative polarity.

The blasting galvanometer 18 is adapted to apply only a 48 volts DC signal of positive polarity to the power terminal of a single blasting cap or to the power line 12 of the blasting circuit and consequently has no inherent capacity to charge the igniter power supply. This enhances the safety of the system since the blaster is assured that any blasting cap connected directly to the blasting galvanometer 18 can only be powered for communications. The blasting machine 20 can also supply 48 V DC to the power line 12 for purposes of enabling communications with the blasting caps in the blasting circuit and is adapted normally to do so when the blasting circuit is coupled to the blasting machine 20. However, when the blasting circuit is to be armed, the blasting machine 20 applies to the power line 12 a power signal of alternating polarity as described above (positive half-cycles of 48 volts and negative half-cycles of −20 volts). In this mode of operation both power supplies can be charged, and each blasting cap in the blasting circuit becomes capable of both general communication with the blasting machine 20 and detonation in response to a firing command.

The IC detonates the explosive charge associated with the EBC1 by actuating the silicon controlled rectifier SCR for conduction. A triggering signal is applied by a resistive divider comprising resistors R3, R4 which are effectively series-connected between the 5 volt supply and the negative voltage terminal of the capacitor C2 when a MOSFET Q4 is turned on. Since the transistor Q4 is a depletion mode device, it tends normally to be non-conductive. The gate of the transistor Q4 is connected to the junction of a resistor R5 and a transistor Q5 which are connected between the 5 volt supply and ground. The transistor Q5 is an enhancement mode device which tends normally to be conductive and is naturally biased to draw current through the resistor R5 driving the gate of the transistor Q4 towards ground thereby keeping the transistor Q4 in a non-conductive state. This arrangement ensures that active steps must be taken to trigger the silicon controlled rectifier SCR and reduces the likelihood that the silicon controlled rectifier SCR may be accidentally actuated during start-up of the blasting cap EBC1.

The IC has a output terminal which is connected to the gate of the transistor Q5. A resistor R13 provides a relatively low impedance path for coupling any significant voltage spike by the IC to ground. The IC can generate an output voltage which will turn the transistor Q5 off thereby turning the transistor Q4 on and ultimately triggering the silicon controlled rectifier SCR.

The capacitor C2 can then discharge through the bridge wire 128 to ignite the explosive charge.

The blasting cap EBC1 comprises means to permit data transfer to and from the IC and the communications line 14 of the blasting circuit. These means include three transistors Q6–Q8 which control transmission of data from the IC. To produce a logic low value at the communications terminal 120, the IC can turn on transistor Q8 thereby coupling the communication terminal 120 to ground. To produce a logic high value, the IC turns off transistor Q8 thereby isolating the communications terminal 120 from ground and turns off transistor Q6. When the transistor Q6 is turned off, the gate of the transistor Q7 rises to the voltage associated with the capacitor C1 and becomes conductive. This in turn couples the communication terminal through a diode D3 (which normally prevents voltages occurring on the communications line 14 from being coupled to the transistor Q7) to the 5 volt supply, generating a logic high value. Signals transmitted to the blasting cap EBC1 on the communication lines are received by the IC through a capacitor C3 which ensures that the data input terminal of the IC is isolated from DC signals. Unless the IC is in a transmission mode, the transistors Q7 and Q8 are shut off so that the communications terminal 120 follows the general signal levels of the communications line 14 itself.

Figure 8:
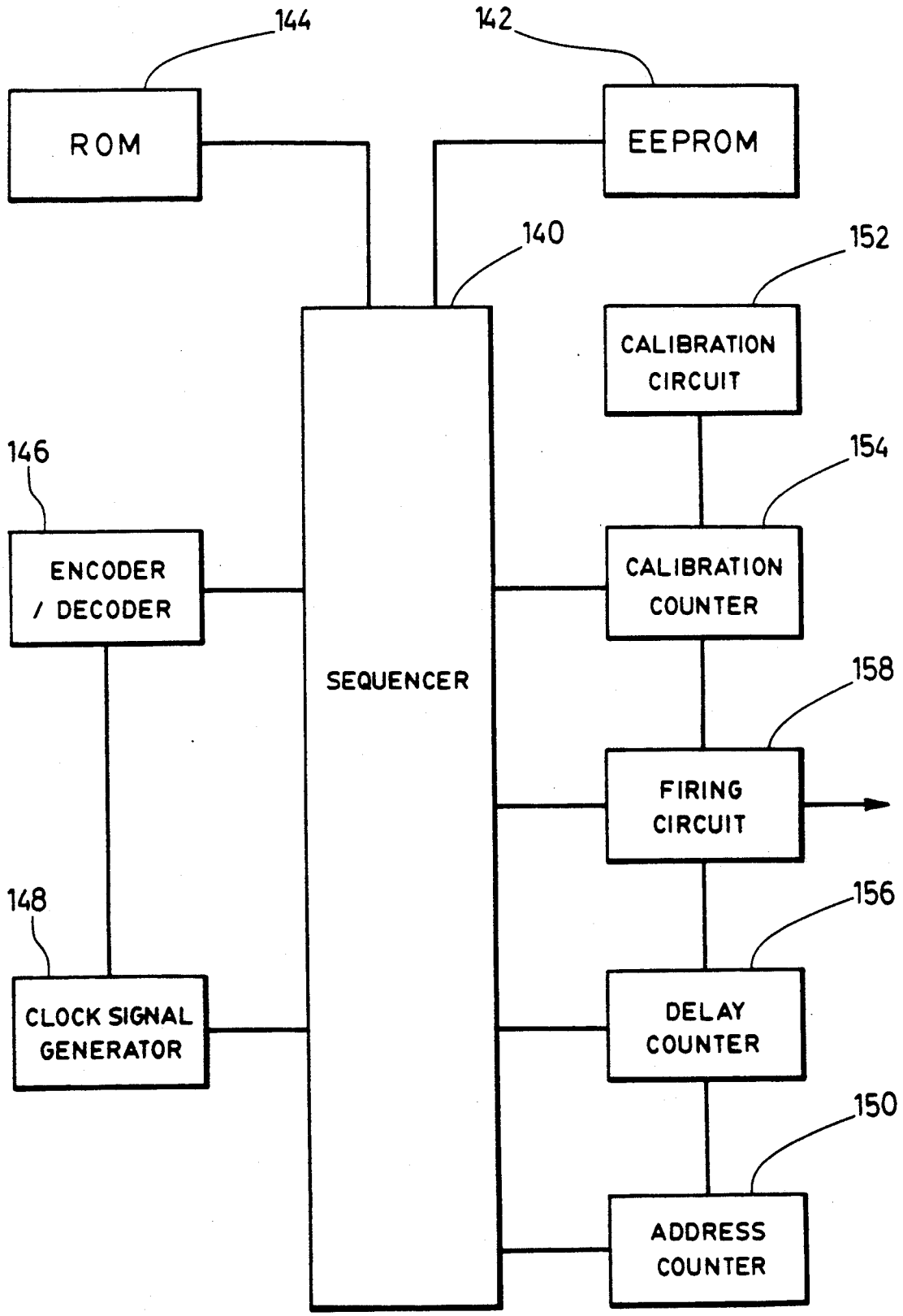
FIG. 8 is a block diagram representation of an integrated circuit employed in the electronic blasting cap.

The principal components of the IC are illustrated in the block diagram of FIG. 8. The IC may be seen to comprise a sequencer 140 which regulates the overall operation of the IC and ultimately the operation of the blasting cap EBC1. An EEPROM 142 serves as non-volatile storage for a security code preprogrammed by the supplier of the blasting cap, an address for use in blasting cap communications with the blasting galvanometer 18 and the blasting machine 20, and a nominal delay setting. The sequencer 140 may be associated with a ROM unit 144 containing appropriate software commands, but may be hardwired to perform predetermined operations. RAM may also be provided to permit the sequencer 140 to temporarily store data. A communications encoding and decoding block 146 regulates the encoding and decoding of data transmitted to and from the sequencer 14 in a conventional manner. A clock signal generator 148 produces clock pulses at a predetermined frequency to regulate the operation of the various components of the IC.

The IC also includes an address counter 150 which can store an address and which can be incremented, decremented and set to a particular value by the sequencer 140. A calibration circuit 152 and calibration counter 154 are provided which are adapted to count digit values encoded in the calibration signal which is transmitted to each of the blasting caps during system calibration. A delay counter 156 is normally set to the nominal delay value stored in the EEPROM 144 until implementation of a calibration function described more fully below when an adjusted delay value is recorded in the counter for purposes of delay counting prior to detonation. A firing circuit 158 is provided which responds to the contents of the delay counter 156. When a firing command is received by the sequencer 14, the firing circuit 158 is enabled for generation of a firing command. The firing circuit 158 has appropriate logic gates which detect when the delay counter 156 has counted down to a zero value at which time the enabled firing circuit 158 generates a firing signal to trigger discharge of the igniter power supply into the bridge wire 128.

The blasting galvanometer 18 and the blasting machine 20 are capable of generating command packets which initiate certain basic functions in the blasting caps. The commands include the following: READ ADDRESS, WRITE ADDRESS, READ DELAY, WRITE DELAY, READ COUNTER, WRITE COUNTER and QUERY ADDRESS. As mentioned above, the command identification field associated with each packet has a unique four bit code which identifies the particular command and is accordingly decoded by each blasting cap. The various commands are described in greater detail below, as is the manner in which such commands are combined to implement the overall operation of the blasting system.

Following is a summary of the basic commands. The READ ADDRESS command is used by the blasting galvanometer 18 to retrieve the address of a blasting cap directly from its EEPROM and incidentally causes the blasting cap also to return the nominal delay setting stored in its EEPROM. The command uses the universal blasting cap address and accordingly is appropriate only where a single blasting cap is connected directly to the blasting galvanometer 18. It permits retrieval of information where a new blasting cap has been attached to the blasting galvanometer 18. The WRITE ADDRESS command is used by the blasting galvanometer 18 to instruct a blasting cap to amend its address as stored in its EEPROM. This command is addressed to a single blasting cap whose address has previously been obtained with a READ ADDRESS command. The READ DELAY command is transmitted to a blasting cap with a known address to retrieve the current delay setting stored in the blasting cap's EEPROM. The WRITE DELAY command is used by the blasting galvanometer 18 to change the nominal delay of a blasting cap having a known address. The command is transmitted together with a new delay setting in the associated data field and effectively overwrites the delay setting stored in the blasting cap's EEPROM. The READ COUNTER command is directed by the blasting machine 20 to a blasting cap of known address to retrieve the contents of its delay counter. It should be noted that during power-up of a blasting cap, the nominal delay stored in the EEPROM is automatically loaded in the delay counter. The WRITE COUNTER command is directed by the blasting machine 20 to a blasting cap of known address to alter the value stored in its delay counter and is normally used during calibration of a blasting cap's delay counting function.

The ADDRESS RANGE command is a global command directed to the universal blasting cap address and can be generated by both the blasting galvanometer 18 and the blasting machine 20. This command causes each blasting cap in the blasting circuit to reset its address counter to a starting address value which is specified in the data field associated with the ADDRESS RANGE command. The QUERY ADDRESS command is a global command which is normally used in connection with the ADDRESS RANGE command. This command causes each blasting cap to increment the value of its address counter and to compare the incremented value with the address stored in its EEPROM. If the two address values correspond, the blasting cap transmits a response packet to the blasting galvanometer 18 or blasting machine 20 identifying its address and the nominal delay value stored in its delay counter.

A WRITE SECURITY CODE command is also recognized by each blasting cap but is not a command which either the blasting galvanometer 18 or blasting machine 20 is capable of generating. This command is directed to the universal address and is used to set or to alter the preprogrammed security code stored in the EEPROM of the blasting cap. It is intended to be used by the supplier of the blasting caps to program the blasting caps for use by only a particular user. This arrangement ensures that stolen or misplaced blasting caps cannot be used by others without knowledge of the relevant security code.

The communications arrangement inherent in the blasting system 10 also involves three global commands which are generated only by the blasting machine 20. These include a SECURITY CODE command which is used to enable the arming of each blasting cap in the blasting circuit, the CALIBRATION command mentioned above which initiates an effective calibration of the timing circuits associated with each blasting cap, and the FIRE command also mentioned above which initiates delay counting and ultimately detonation of each blasting cap.

The data field associated with the SECURITY CODE command contains a security code composed by the blaster. Each blasting cap compares the transmitted security code with the security code stored in in its associated EEPROM as prerecorded by the manufacturer or supplier. If the transmitted code and the stored code correspond, the associated IC disables and puts into a non-conductive state the transistor which shorts the capacitor C2 of its igniter power supply; that is, charging of the igniter power supply is enabled. Thereafter, when the arm lock switch 80 associated with the blasting machine 20 is set to its on position, each blasting cap is capable of receiving and storing the electric charge necessary to detonate its explosive charge.

The CALIBRATION command has been described above and will only be described in brief detail to indicate the activities initiated in each blasting cap of the blasting circuit. Each blasting cap counts the 5's and 9's in the bit pattern transmitted by the blasting machine 20. This test count is stored in the calibration counter associated with the blasting cap. Each blasting cap also applies clock pulses generated by its local clock generator circuit to its associated delay counter which effectively tallies the clock pulses, starting with the leading edge of data field of the calibration signal and terminating with the trailing edge of the data field. If the blasting cap misrecords more than 20% of the embedded 5's and 9's, it automatically retrieves the nominal delay stored in its EEPROM and resets its delay counter to the nominal delay value. This serves as an indicator to the blasting machine 20 that a valid CALIBRATION command was not recognized and that the calibration mode of operation failed, but it may be preferred to set an appropriate flag in a data packet returned in response to counter enquiries initiated subsequent to the CALIBRATION command.

The FIRE command has been described above and will only be described in brief detail to indicate the activities initiated in each blasting cap if the blasting circuit. The blasting caps counts the 5 and 9 code segments in the data field of the FIRE command. The total value of this test count is stored in the calibration counter associated with the blasting cap (rather than providing a separate counter for such purposes). If a blasting cap recognizes a valid FIRE command, the trailing edge of the commands data field causes the blasting cap to apply pulses generated by its clock signal generator to its delay counter, causing the delay counter to count downwardly from the blasting delay value stored in the counter to zero. When the zero level is reached, logic gates associated with the delay counter produces a logic high value and effectively trigger the silicon controlled rectifier associated with each blasting cap to power the associated bridge wire.

Overall system operation will now be described with reference to the manner in which a blaster might potentially operate the blasting system.

The blaster first examines the blast site and determines where the blasting caps should be installed, preparing a map showing the expected location of each blasting cap and the delay which is required for each blasting cap. Such matters are within the general knowledge of an expert blaster and will not be described in greater detail.

The blasting caps are then be connected individually to the blasting galvanometer 18. Upon connection of a particular blasting cap, the blasting galvanometer 18 automatically applies 48 volts to the power terminal associated with the blasting cap. This charges the control logic power supply only and enables the IC associated with the blasting cap to initiate start-up of the various functions required. In connection with the start-up procedure, the sequencer associated with the IC loads the preprogrammed delay stored in the blasting cap's EEPROM into the blasting cap's delay counter. The blasting cap is then ready for communications with the blasting galvanometer 18.

The blaster can test whether a blasting cap is functioning properly by depressing the test key 36. The blasting galvanometer 18 then displays the prompt CONNECT CAP, asking that a blasting cap be connected. The blasting cap can be connected prior to or after depressing the test key 36, the messages and procedures remaining substantially the same. Once the prompt is acknowledged by depressing the enter key 50, the blasting galvanometer 18 transmits a READ ADDRESS command to the blasting cap using the universal blasting cap address, thereby causing the blasting cap to return a response packet containing both its current address and also its nominal delay. In response to receipt of the data packet, the blasting galvanometer 18 simultaneously displays the message CAP OK, indicating that the blasting cap is operating properly. Although the complete range of blasting cap functions is not tested by the READ ADDRESS command, in practice the ability of the blasting cap to respond to the READ ADDRESS command properly will be a good indicator that the blasting cap is otherwise fully operative. If no response packet is received from the blasting cap after eight attempts transmissions of READ ADDRESS command, the blasting galvanometer 18 displays the message CAP ERROR, indicating that the blasting cap may be defective. It should be noted that this testing function is inherent in other blasting galvanometer 18 functions such as setting blasting cap addresses and delays and if operations other than simple testing are contemplated then the testing step can be skipped.

The blaster can then set a new address for the blasting cap. The object at this stage of operations is to assign an address which will uniquely identify the blasting cap in the blasting circuit. The blasting caps are preferably assigned consecutive addresses as this reduces the time required by the blasting galvanometer 18 at later stages of operation to check whether the blasting caps are operatively coupled to the required blasting circuit. This also simplifies scanning of the blasting circuit for improperly connected blasting caps and expedites the operations of the blasting machine 20, as described more fully below.

To initiate the setting of the blasting cap's address, the blaster depresses the set address key 38. The blasting galvanometer 18 then transmits a READ ADDRESS command to the blasting cap using the universal blasting cap address, awaits a response packet containing the current address and nominal delay of the blasting cap, and stores the returned information in its RAM 56. The blasting galvanometer 18 then displays the CAP OK message indicating that the blasting cap is functioning. (The blasting galvanometer 18 otherwise indicates a blasting cap malfunction.) The message is acknowledged by depressing the enter key 50, and the blasting galvanometer 18 then displays the message ADDRESS SET followed by the current address recorded in the blasting cap. The blaster acknowledges the message, and the blasting galvanometer 18 prompts the blaster to enter a new address with the message NEW ADDRESS. The blaster then composes and enters the new address which is loaded into a particular RAM location for temporary storage and which is initially set to a zero value. Alternatively, the blaster can simply depress the increment key 44 which increments the value stored in the memory location and initially set to zero by 1. The blasting galvanometer 18 then transmits a WRITE ADDRESS command containing the new address to the blasting cap. This causes the blasting cap to write the new address into the EEPROM for use in further communications and a response packet is returned which essentially confirms receipt of the WRITE ADDRESS command. The blasting galvanometer 18 then transmits a READ ADDRESS command (using the universal blasting cap address) to the blasting cap to cause return of a data packet containing the address of the blasting cap as currently recorded in its EEPROM. The blasting galvanometer 18 compares the address information returned with the address originally transmitted, and generates the message CAP OK if the address has been properly recorded by the blasting cap and otherwise displays the message CAP ERROR indicating a failure to properly record the newly assigned address.

The blaster can then set the blasting delay to be associated with the particular blasting cap by depressing the set delay key 40. The blasting galvanometer 18 once again transmits a READ ADDRESS command to the blasting cap, records the address and nominal delay information returned by the blasting cap, and indicates whether the blasting cap is functioning properly, as before. The blaster then depresses the enter key 50 and the message DELAY SET followed by the retrieved delay information is displayed. The blaster acknowledges the message, and the blasting galvanometer 18 prompts the blaster with the message SET DELAY to enter a new delay setting. The new delay is composed on the keyboard 24 in one millisecond increments ranging from 0 to 10,000 milliseconds. Depressing the enter key 50 causes the newly composed delay setting to be stored in the RAM 56 associated with the blasting galvanometer 18. The blasting galvanometer 18 then transmits to the blasting cap a WRITE DELAY command containing in its data field the new delay setting. The blasting cap responds by returning a data packet confirming receipt of the WRITE DELAY command and updates the nominal delay recorded in its EEPROM. To confirm proper recording by the blasting cap, the blasting galvanometer 18 then transmits another READ ADDRESS command to retrieve the address and delay information recorded in the blasting cap. If the delay information returned by the blasting cap corresponds to that originally transmitted with the WRITE DELAY command, the blasting galvanometer 18 displays the message CAP OK, indicating proper recording of the new delay setting.

The procedure of initializing an address and delay is repeated by connecting each required blasting cap individually to the blasting galvanometer 18. During address setting, the blaster uses the increment key 44 so that addresses tend to be assigned consecutively to the blasting caps. The blaster may record each address and each delay on the exterior of each blasting cap as it is processed so that he can readily identify which programmed blasting cap is to be associated with a particular location on his blasting map. He can then install the blasting caps at the blast site, connecting each blasting cap to the power, communications and common lines of the blasting circuit.

The testing function, the address setting function, and the delay setting functions are independent of one another. This will be apparent from the fact that each operation initiates its procedures with a READ ADDRESS command using the universal blasting cap address to retrieve both the communications address of a blasting cap and its delay. Accordingly, these functions can be performed in any order and can be repeated as desired.

Once the blaster has connected the blasting circuit, he can perform a network check to determine whether all blasting caps in his blasting circuit are functioning and properly connected. The blaster connects the auxiliary power supply to the blasting galvanometer 18 which results in the blasting galvanometer 18 adapting itself for network operations. The blaster then depresses the network check key 42 and the blasting galvanometer 18 prompts the blaster to connect a blasting circuit. The blasting galvanometer 18 may be connected to the blasting circuit either before or after the network check key 42 has been depressed. The message is acknowledged with the enter key 50, and the blasting galvanometer 18 prompts the blaster with the message CIRCUIT SIZE to enter the number of blasting caps associated with the circuit. Upon composition and entry of this information, the blasting galvanometer 18 prompts the blaster with the message FROM to enter the lower limit of the values of the addresses which have been assigned to the blasting caps. If the addressing procedure described above has been followed, the blaster simply enters the digit 1. The blasting galvanometer 18 then prompts the blaster with the message TO to obtain the upper limit of the addresses assigned to the blasting caps. The information thus entered is recorded in the RAM 56 of the blasting galvanometer 18 and defines limits for a search for the blasting caps connecting to the blasting circuit.

The blasting galvanometer 18 then transmits along the communications line 14 the global ADDRESS RANGE command. The data field associated with the command contains the lower address limit specified by the blaster decremented by 1. The blasting caps respond to the command by entering the starting address into their respective address counters. The blasting galvanometer 18 then transmits a global QUERY ADDRESS command and the sequencer associated with each blasting cap responds by incrementing the associated address counter by 1 unit. Each sequencer compares the contents of the address counter with the communications address stored in the associated EEPROM value of current address. If one of the blasting caps has a communications address corresponding to the contents of the counter, the associated sequencer causes transmission of a response packet containing in its data field the blasting cap's address and the delay recorded in the associated delay counter. In this instance, the address and delay information is not required, and the blasting galvanometer 18 simply increments a tally in its RAM 56.

The blasting galvanometer 18 repeatedly transmits the QUERY ADDRESS command to retrieve addresses and delays from each of the blasting caps. The command is transmitted until the tally of responses from the blasting cap reaches the size of the blasting circuit specified by the blaster or until the full range of addresses specified by the blaster has been exhausted, whichever occurs first. When the process is complete, the blasting galvanometer 18 displays the message CAPS CONNECTED together with the tally of the caps located.

It should be noted that entry of the circuit size, the lower address limit, and the upper address limit is optional. If no such information has been provided, the blasting galvanometer 18 will assume a lower address limit of 1 and will send QUERY ADDRESS signals until all address counters in the blasting caps have been incremented up to the maximum blasting circuit address of 100,000. This is necessary if the blaster elects not to follow the addressing procedure described above in which consecutive addresses are assigned. If any information is provided, the number of blasting caps, the lower address limit or the upper address limit, the blasting galvanometer 18 will limit the searching process accordingly. For example, if the total number of blasting caps in the circuit is provided, the blasting galvanometer 18 will assume an address search range of 1 to 100,000 but will terminate its search if the specified number of blasting caps are found with less than 100,000 QUERY ADDRESS commands. It will be apparent that such operation provides considerable freedom in how the blasting circuit is established yet permits a very considerable reduction in network checking time if information can be provided to the blasting galvanometer 18 regarding circuit size or blasting cap address limits.

If the blasting galvanometer 18 reports fewer responsive blasting caps than have been connected to the blasting circuit, the blaster can scan the blasting circuit to determine which blasting caps are not properly connected (or otherwise inoperative). This can be done by depressing the test key 36. Since the auxiliary power supply has been connected and the blasting galvanometer 18 is in a network checking mode, the blasting galvanometer 18 does not respond by transmitting a READ ADDRESS signal directed to the universal address but instead prompts the blaster with the message SELECT ADDRESS to enter at the keyboard 24 the address of a particular blasting cap to be tested. The blasting galvanometer 18 then transmits a READ DELAY command to the selected blasting cap. If no response packet is received, the blasting galvanometer 18 displays the message CAP NOT FOUND, indicating that the particular blasting cap is non-responsive. This process can be repeated until all non-responsive blasting caps are located and either replaced or properly connected to the blasting circuit. It should be noted that the blasting galvanometer's response to operation of the address and delay keys is similarly modified by connection of the auxiliary power supply to permit blasting caps in the blasting circuit to be individually addressed for purposes of changing blasting delays and addresses.

It is within the ambit of the present invention to adapt the blasting galvanometer 18 to compose a table of all blasting cap addresses and delays during the network checking operation and to provide appropriate function keys which permit the blaster to display sequentially the address or delay associated with each blasting cap located by the blasting galvanometer 18 and thereby check against his blasting map which blasting caps are non-responsive.

Once the blasting circuit has been checked and is considered fully operative, the blaster connects the blasting machine 20 to the circuit to initiate the detonation function. Upon start-up, the blasting machine 20 prompts the blaster to connect the blasting circuit to the blasting machine 20, which connection can be made before or after the prompt has been displayed. The blaster acknowledges the prompt by depressing the enter key of the blasting machine keyboard 74 and the blasting machine 20 indicates that it is ready to receive further instructions.

The first operation to be performed by the blaster is entry of a security code for purposes of enabling the blasting caps for receipt of power and ultimately detonation. The blaster depresses the security code key and the blasting machine 20 then prompts the blaster to enter the security code at the keyboard 74. Once the security code entered, the blasting machine 20 transmits a global SECURITY CODE command containing the newly entered security code to all blasting caps. Each blasting cap compares the transmitted security code with the security code preprogrammed by the supplier and stored in the associated EEPROM and if there is a correspondence turns off the transistor which normally discharges the capacitor associated with the igniter supply. Accordingly, each blasting cap is now conditioned to receive power to charge its igniter power supply.

The blaster can then set the arm lock switch 80 to the on position. This triggers the blasting machine 20 to perform essentially the same network check function as has been described above in connection with the operation of the blasting galvanometer 18. The blasting machine 20 prompts the blaster to enter the circuit size the lower limit of the addresses of the blasting caps in the blasting circuit, and the upper limit of such addresses. The blasting machine 20 then transmits a global AD- DRESS RANGE command which loads into the address counters associated with each blasting cap the lower address limit less the value 1. Global QUERY ADDRESS commands are then transmitted by the blasting machine 20 according to the information entered by the blaster, and the blasting machine 20 displays the number of blasting caps which have responded. The principal difference between the network check function performed by the blasting machine 20 and the blasting galvanometer 18 is that the blasting machine 20 stores the address and nominal blasting delay returned by each responsive blasting cap essentially as a table in the RAM of the blasting machine 20, for later retrieval and does not immediately display the results of its network checking operation.

The blasting machine 20 then transmits a global CALIBRATE command to the blasting caps. The delay counter associated with each blasting cap is cleared upon decoding of the CALIBRATE command, and the local clock signal generator associated with each blasting cap increments the counter periodically until the CALIBRATE command terminates, the delay counter effectively counting and tallying the clock pulses to generate a test count. Each blasting cap simultaneously counts the number of BCD data segment representing combinations of the digits 5 and 9. If a miscount exceeding the error limit specified above has occurred in any blasting cap, it replaces the contents of its delay counter with the nominal delay stored in its associated EEPROM.

The blasting machine 20 then transmits a series of READ COUNTER commands to the blasting caps to retrieve the calibration test counts. The commands are transmitted sequentially to each blasting cap using the blasting cap addresses stored in the table previously assembled by the blasting machine 20 in its RAM. Each blasting cap responds by returning a data packet containing the calibration test count stored in its delay counter. The blasting machine 20 is preprogrammed to expect each blasting cap to return a predetermined test count, assuming the local clock generators of the various blasting caps are operating at the same frequency. Because of manufacturing tolerances, aging of circuit components and environmental conditions, each blasting cap may, however, return a calibration test count which differs from the predetermined count, indicating that the operating frequency of the local clock signal generator associated with the blasting cap is either too high or too low. The blasting machine 20 retrieves from the RAM the nominal delay associated with the particular blasting cap and adjusts the nominal delay by a scaling factor which corresponds to the actual test count returned from the blasting cap divided by the predetermined expected count. The blasting machine 20 then transmits a WRITE COUNTER command addressed to the particular blasting cap and containing in its data field the adjusted or scaled delay value. The blasting cap responds to the WRITE COUNTER command by recording the adjusted delay value in its delay counter, the nominal delay stored in the associated EEPROM being unaffected. It will be appreciated that this procedure compensates for discrepancies in the clock rates of the various blasting caps and tends to synchronize the operation of the blasting caps during the detonation process.

If the test count returned for any blasting cap corresponds to the nominal delay value as stored in the RAM of the blasting machine 20, the blasting machine 20 does not send a WRITE COUNTER command to the particular blasting cap. The blasting machine 20 recognizes he failure of one or more blasting caps to recognize the CALIBRATION command by repeating the calibration procedure, but only once. If any blasting cap still fails to recognize a valid CALIBRATION command and to properly implement its calibration operation, the unadjusted nominal delay value remains in its delay counter for use during detonation. The blasting machine 20 then switches its power supply to apply to the power transmission line associated with the blasting circuit the voltage of alternating polarity which charges the igniter supplies of the various blasting caps and maintains the control and communications functions of the blasting caps. At the end of this calibration operation, the blasting machine 20 reviews the table of data stored in its RAM and displays a message indicating the number of responsive blasting caps in the blasting circuit and indicating that the blasting caps are armed.

The blaster may at this stage disarm the blasting circuit by switching the arm lock switch 80 to its OFF position. In response to such operation of the arm lock switch 80, the blasting machine 20 transmits a global QUERY ADDRESS command to the blasting caps in the blasting circuit. The sequencers associated with the blasting caps are programmed to recognize the occurrence of an ADDRESS RANGE command followed by a series of QUERY ADDRESS commands as a particular operational unit. The transmission of an isolated QUERY ADDRESS command is understood by each blasting cap as a command to disarm the associated igniter power supply. The QUERY ADDRESS command has been selected for a dual function in this particular embodiment of a blasting system in order to reduce the number of commands required. It is entirely within the ambit of the present invention to employ a distinct command for such purposes.

Assuming that the blaster has elected to proceed with detonation of the blasting circuit, he can then set the fire lock switch 82 to the fire position. The blasting machine 20 then transmits the global FIRE command to each of the blasting caps. The blasting caps decode the command identification code container in the FIRE COMMAND and initiate the tallying of the distinct BCD segment representing the digits 5 and 6 in the calibration counter. If the component count so generated is within the error bound specified above, each blasting cap upon termination of the FIRING command applies the clock pulses generated by the local clock signal generator to the delay counter. This causes the delay counter to count downwardly from the adjusted delay value stored therein to zero. When the delay counter in each blasting cap reaches zero, the associated igniter power supply is coupled to the associated bridge wire and the blasting cap is detonated.

It will be appreciated that particular embodiments of a blasting galvanometer, a blasting machine and an electronic blasting cap have been described for purposes of illustrating the principles of the invention and the particular features of these devices should not be regarded as necessarily restricting the scope of the appended claims.

TABLE 1

| Message Displayed | Purpose of Message |
|---|---|
| CONNECT CAP | prompts connection of a blasting cap |
| CONNECT CIRCUIT | prompts connection of a blasting circuit |
| NEW ADDRESS | prompts entry of new address for a |

TABLE 1-continued

| Message Displayed | Purpose of Message |
|---|---|
| | blasting cap |
| ADDRESS SET | prompts confirmation of a displayed blasting cap address |
| SELECT ADDRESS | prompts entry of a blasting cap address |
| NEW DELAY | prompts entry of new delay setting for a blasting cap |
| SET DELAY | prompts confirmation of new delay setting |
| CIRCUIT SIZE | prompts entry of the number of caps in a circuit |
| FROM | requests the first address of network check function |
| TO | requests the last address of network check function |
| _CONNECTED | displays the number of caps detected in a circuit |
| CAP ERROR | indicates malfunction of a direct-connected blasting cap |
| CAP OKAY | indicates proper operation of a direct-connected blasting cap |
| CAP NOT FOUND | indicates that a particular blasting cap in a circuit is not responding |

TABLE 2

| Message Displayed | Purpose of Message |
|---|---|
| CONNECT CIRCUIT | prompts the blaster to connect a blasting circuit |
| SECURITY CODE | prompts entry of a security code |
| ARMING | advises the blaster that arming is in process |
| _CONNECTED | displays number of caps detected in a blasting circuit |

I claim:

1. A blasting device comprising:

an explosive charge;

electrically-operable igniter means for igniting the charge when the igniter means are actuated;

electrically-operable control means for controlling the actuation of the igniter means;

a communications terminal, a power receipt terminal and a reference terminal, each of the terminals being accessible externally of the explosive device;

chargeable power supply means for providing electric power to the control means and the igniter means, the power supply means being connected to the power receipt and reference terminals for receipt and storage of electric energy;

the control means comprising (a) communication means connected to the communications and reference terminals for receipt of signals including a blasting delay signal specifying a required blasting delay and a blasting signal and connected to the communications and reference terminals for transmission of signals from the device, (b) recording means for recording at least the specified blasting delay, (c) timing means for determining when a time interval corresponding to the recorded blasting delay has expired following receipt of the blasting signal, and, (d) means for actuating the igniter means to ignite the charge at least in part in response to expiry of the time interval.

2. The blasting device of claim 1 in which the power supply means comprise:

chargeable igniter power supply means for supplying stored electric energy to the igniter means;

chargeable control power supply means for supplying stored electric energy to the control means, the control power supply means being separately chargeable from the igniter power supply means.

3. The blasting device of claim 2 in which the chargeable power supply means comprise charging means for supplying electric power associated with an electric signal received at the power receipt terminal selectively to the igniter power supply means and to the control power supply means in response to different states of the electric signal.

4. The blasting device of claim 3 which:

the charging means define a first power transmission path from the power receipt terminal to the igniter power supply means and a second power transmission path from the power receipt terminal to the control power supply means; and, the charging means comprise a plurality of unidirectional semiconductor devices in the first and second power paths, the unidirectional semiconductor devices being oriented to permit transmission of power along the first power transmission path only when the electric signal has a first polarity and to permit transmission of power along the second power transmission path only when the electric signal has an opposite polarity.

5. The blasting device of claim 4 in which each of the igniter power supply means and the control power supply means comprise a capacitor for storing electric energy.

6. The blasting device of claim 5 in which the capacitor of the control power supply means has a capacitance selected such that the control power supply means can be charged in response to the electric signal only to an energy level insufficient to operate the igniter means.

7. The blasting device of claim 2 comprising controllable discharging means for discharging electric energy from the igniter power supply means, the control means controlling the discharging means to discharge the igniter power supply means in response to a predetermined signal received at the communications terminal.

8. The blasting device of claim 7 in which:

the discharging means are adapted normally to discharge any electric energy stored in the igniter power supply means:

the recording means store a predetermined code;

the control means are adapted to compare a code signal received at the communications terminal with the predetermined code and comprise means for suppressing the discharging of the igniter power supply means by the discharging means when the received code signal corresponds to the predetermined code.

9. The blasting device of claim 1 in which:

the timing means include clock means for generating a clock signal comprising a series of pulses of predetermined duration and counting means for counting the pulses;

the control means have a calibration mode of operation in which the control means respond to a calibration signal of finite duration received by the communications means, the control means initiating counting of the pulses by the counting means upon receipt of the calibration signal and stopping counting of the pulses by the counting means upon termination of the calibration signal to produce a calibration test count;

the control means cooperate with the communications means in response to a predetermined test count recovering signal received by the communications means to transmit to the communications terminal a response signal indicating the calibration test count;

whereby, an adjusted blasting delay corresponding to the blasting delay required for the explosive adjusted according to the calibration test count can be calculated externally of the explosive device and transmitted to the explosive device for recording in the recording means.

10. The blasting device of claim 9 in which the control means are adapted to transmit a signal from the communications terminal indicating the recorded blasting delay in response to a predetermined signal received at the communications terminal.

11. The blasting device of claim 10 responsive in the calibration mode of operation to receipt at the communications terminal of a calibration signal of finite duration containing a predetermined number of predetermined signal components, comprising:

calibration testing means for detecting and counting the number of predetermined signal components in the calibration signal received by the communications means, the calibration testing means generating a component count indicating the number of predetermined signal components detected in the calibration signal;

the control means causing the response signal to indicate a failure in the calibration mode of operation in the event that the component count is less than a predetermined number.

12. The blasting device of claim 1 in which the control means have an address setting mode of operation in which the control means respond to an address setting signal received by the communication means by storing in the recording means an address assigned by the address setting signal;

the control means have a communications mode of operation in which the control means controls the operation of the explosive device only in response to signals received at the communications terminal which are addressed to a predetermined universal address or which are addressed to the assigned address.

13. The blasting device of claim 12 in which the control means are adapted to respond to a predetermined starting address signal received at the communications terminal and addressed to the universal address by storing in the recording means a starting address identified by the starting address signal and in which the control means are adapted to respond to a predetermined incrementing signal received at the communications terminal and addressed to the universal address by incrementing the recorded value of the starting address by a predetermined amount, comparing the incremented starting address with the recorded assigned address, and cooperating with the communications means to transmit a predetermined response signal if the incremented starting address corresponds to the recorded assigned address.

14. The blasting device of claim 1 adapted to respond to a blasting signal of finite duration containing a predetermined number of predetermined signal components, comprising:

blasting signal testing means for detecting and counting the number of predetermined signal components in the blasting signal as received by the communications means, the blasting signal testing means generating a component count indicating the number of predetermined signal components detected in the blasting signal;

the control means being adapted to suppress actuation of the igniter means if the component count is less than a predetermined number.

* * * * *